US007437858B2

(12) United States Patent
Pfeiffer et al.

(10) Patent No.: US 7,437,858 B2
(45) Date of Patent: Oct. 21, 2008

(54) WELDED WIRE REINFORCEMENT FOR MODULAR CONCRETE FORMS

(75) Inventors: Henry E. Pfeiffer, Omaha, NE (US); Kelvin Leslie Doerr, Omaha, NE (US); Karen Ann Bexten, Omaha, NE (US); Maher Khalil Tadros, Omaha, NE (US)

(73) Assignee: Reward Wall System, Inc., Omaha, NE (US)

( * ) Notice: Subject to any disclaimer, the term of this patent is extended or adjusted under 35 U.S.C. 154(b) by 802 days.

(21) Appl. No.: 10/770,811

(22) Filed: Feb. 3, 2004

(65) Prior Publication Data

US 2004/0216415 A1 Nov. 4, 2004

Related U.S. Application Data

(60) Provisional application No. 60/444,741, filed on Feb. 4, 2003.

(51) Int. Cl.
*E04B 2/00* (2006.01)

(52) U.S. Cl. ..... 52/309.11; 52/426; 52/565

(58) Field of Classification Search ..... 52/309.11, 52/309.12, 309.16, 309.7, 432, 426, 506.07, 52/565, 633, 649.1, 650.1
See application file for complete search history.

(56) References Cited

U.S. PATENT DOCUMENTS 2,177,246 A * 10/1939 Ellis ..... 248/188.91
3,691,311 A * 9/1972 Wilson ..... 379/294
3,778,951 A * 12/1973 Oroschakoff ..... 52/646
3,788,020 A 1/1974 Gregori
3,959,944 A * 6/1976 Oroschakoff ..... 52/665
4,321,779 A * 3/1982 Kratchmer ..... 52/425
4,706,429 A * 11/1987 Young ..... 52/309.12
4,730,422 A 3/1988 Young
4,879,855 A 11/1989 Berrenberg
4,884,382 A 12/1989 Horobin
4,916,879 A 4/1990 Boeshart
5,351,455 A 10/1994 Schoonover et al.
5,390,459 A 2/1995 Mensen (Continued)

FOREIGN PATENT DOCUMENTS

EP 0570717 4/1993

(Continued)

*Primary Examiner*—Robert Canfield
*Assistant Examiner*—Christine T Cajilig
(74) *Attorney, Agent, or Firm*—Husch Blackwell Sanders LLP

(57) ABSTRACT

A welded wire reinforcement is used in combination with insulated concrete form blocks having opposed panels joined by form ties. A method of construction forms building structures with insulated concert form blocks. The reinforcement member has a base bar and a plurality of arms extending downwardly from the base bar and is utilized to provide increased internal strength to a modular concrete wall system. The welded wire reinforcement provides vertical and horizontal support without requiring any extra time or material to connect a vertical reinforcement to the concrete forms of the wall system. An alternate embodiment of the reinforcement member includes a horizontal base bar, arms extending downward and perpendicular from the base bar, and a plurality of end pieces attached to the arms to form a discontinuous bottom bar. The base bar and bottom bar are slidably received in rebar chairs defined by the form ties. Another embodiment of the reinforcement member is utilized for reinforcing a modular concrete wall form with a ledge.

6 Claims, 3 Drawing Sheets

U.S. PATENT DOCUMENTS

| | | | | | |
|---|---|---|---|---|---|
| 5,454,199 | A | | 10/1995 | Blom et al. | |
| 5,596,855 | A | | 1/1997 | Batch | |
| 5,611,183 | A | * | 3/1997 | Kim | 52/426 |
| 5,617,693 | A | | 4/1997 | Hefner | |
| 5,809,727 | A | * | 9/1998 | Mensen | 52/426 |
| 5,839,243 | A | * | 11/1998 | Martin | 52/439 |
| 5,845,449 | A | | 12/1998 | Vaughan et al. | |
| 5,890,337 | A | * | 4/1999 | Boeshart | 52/426 |
| 5,896,714 | A | * | 4/1999 | Cymbala et al. | 52/426 |
| 6,070,380 | A | * | 6/2000 | Meilleur | 52/309.7 |
| 6,230,462 | B1 | | 5/2001 | Beliveau | |
| 6,276,104 | B1 | * | 8/2001 | Long et al. | 52/309.4 |
| 6,318,040 | B1 | * | 11/2001 | Moore, Jr. | 52/426 |
| 6,820,384 | B1 | * | 11/2004 | Pfeiffer | 52/426 |
| 7,059,577 | B1 | * | 6/2006 | Burgett | 249/40 |
| 7,082,731 | B2 | * | 8/2006 | Patz et al. | 52/426 |
| 2006/0213140 | A1 | * | 9/2006 | Morin et al. | 52/426 |

FOREIGN PATENT DOCUMENTS

| | | | |
|---|---|---|---|
| GB | 517915 | | 2/1940 |
| GB | 2170258 | | 7/1986 |
| GB | 2170258 | A * | 7/1986 |
| GB | 2240121 | | 7/1991 |

* cited by examiner

WELDED WIRE REINFORCEMENT FOR MODULAR CONCRETE FORMS

CROSS-REFERENCE TO RELATED APPLICATION

This utility application claims the benefit of Provisional Application No. 60/444,741, filed Feb. 4, 2003.

FIELD OF THE INVENTION

This invention relates to reinforcements for concrete structures and, more particularly, to a welded wire reinforcement for modular concrete forms.

BACKGROUND OF THE INVENTION

Insulated concrete walls constructed with pre-fabricated forms are used to form structural walls both below and above grade. Generally, pre-fabricated foam blocks, which are made with two parallel foam panels held together by form ties, are assembled to form the desired structure. Reinforcing members, such as rebar, are positioned inside the blocks during assembly, and concrete is poured into the foam blocks to complete the walls. These walls provide superior strength and efficiency as opposed to the traditional poured wall construction with above grade wood frame walls. Insulated concrete walls provide all of the features of conventional wood frame construction including doors, windows, and decorative architectural features, such as ledges and further provide additional insulating capability and increased durability and safety.

The modular concrete forms are simple to position, but the reinforcing members used to provide internal reinforcement can require extra work to prepare and install. Several rebar reinforcements may be required to achieve the desired level of internal strength, often necessitating placement of several vertical rebar reinforcements in the wall. While horizontally oriented rebar are easily positioned into rebar chairs provided on the form ties of the pre-fabricated forms, the vertically oriented rebar reinforcements often must be tied into place. For less ordinary forms, such as those used to create ledges, the reinforcements must be bent or angled, further increasing labor.

BRIEF SUMMARY OF THE INVENTION

There is, therefore, provided in the practice of the invention a novel welded wire reinforcement for quickly and efficiently reinforcing a modular concrete form wall system. The welded wire reinforcement includes a base bar and several arms extending from the base bar. The welded wire reinforcement is positioned in a rebar chair of a modular concrete form to provide enhanced strength and stability.

In a preferred embodiment, a welded wire reinforcement includes a base bar and several arms extending downward from the base bar. The arms include end pieces that are positioned in various, selected locations along the arm.

In another preferred embodiment, the welded wire reinforcement is bent to provide reinforcement to concrete forms used to create ledges. The bent wire reinforcements have a base bar and several arms that are bent to form approximately a 90° angle. The arms include end pieces that are positioned at the end of the arms.

Accordingly, it is an object of the present invention to provide an improved welded wire reinforcement for use in modular concrete form wall systems.

It is a further object of the present invention to provide an improved bent wire reinforcement for use in modular concrete form wall systems to enhance the strength of a concrete form that creates a ledge.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 1:
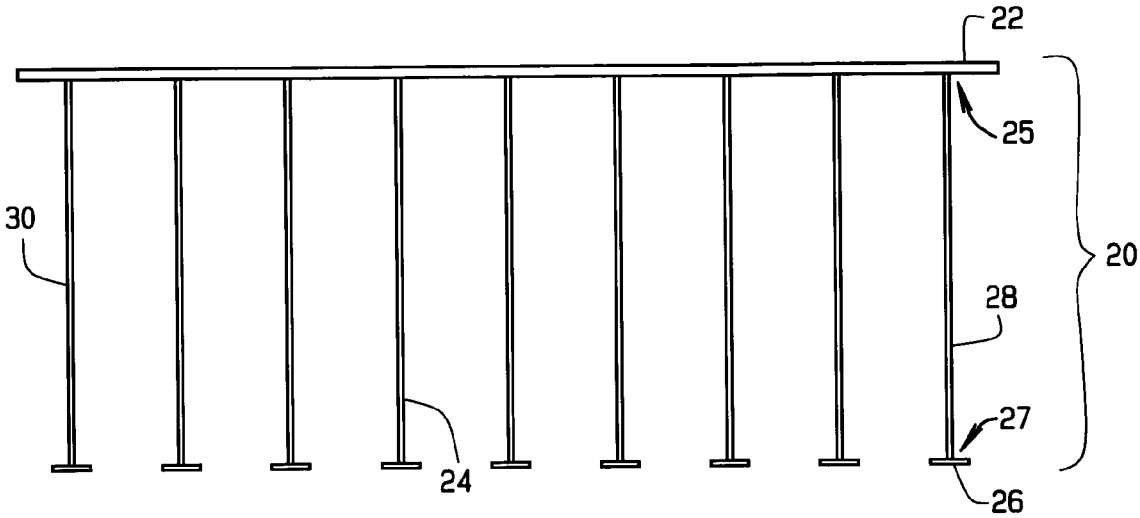
FIG. 1 is a front view of a welded wire reinforcement according to the present invention.

Referring to the drawings in greater detail, FIG. 1 shows a welded wire reinforcement 20 constructed in accordance with a preferred embodiment of the present invention. The reinforcement 20 includes a substantially rigid base bar 22 and several substantially rigid arms 24 preferably welded to the base bar 22. Substantially rigid means that the members have sufficient tensile strength to reinforce an intend structure. The reinforcement member is operable to reinforce a concrete wall formed using modular concrete form blocks, including pre-assembled forms and field-assembled forms. While top, bottom, vertical, horizontal, and other orientations are referenced in the specification and claims, it is understood that the structure of the invention could be utilized in other orientations.

Figure 2:
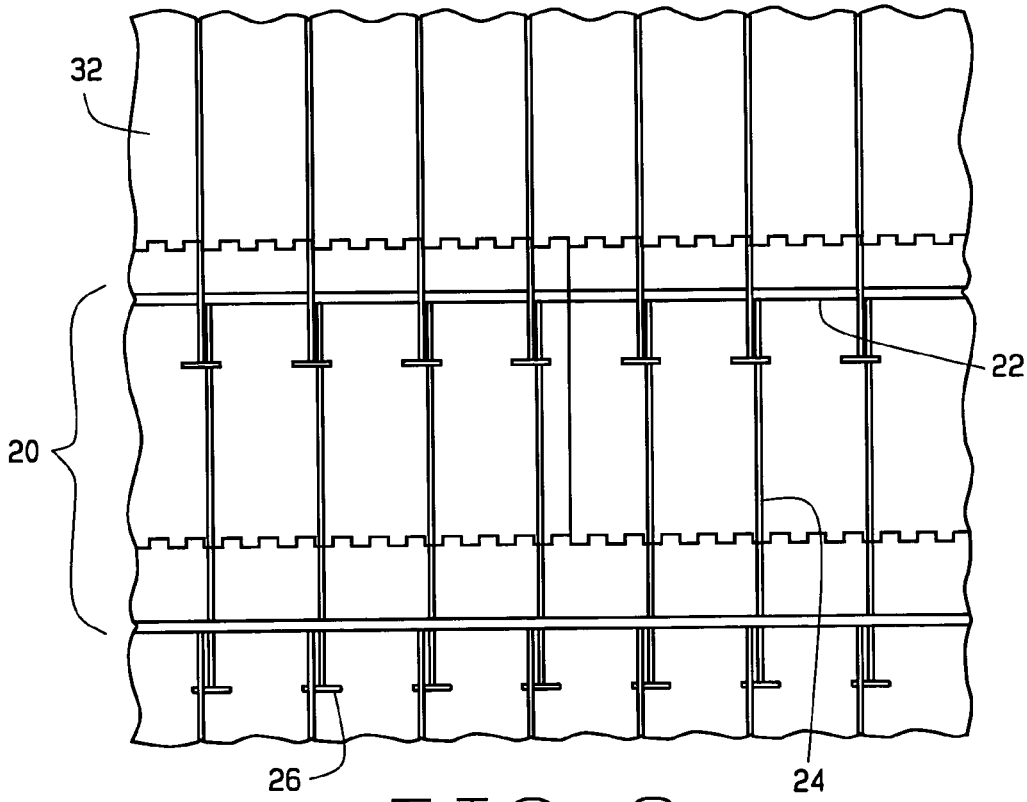
FIG. 2 is a side view of FIG. 1.

In a preferred embodiment, the base bar 22, as shown in FIGS. 1 and 2, is a substantially straight and rigid wire having a bar length extending across the top of the welded wire reinforcement 20 in a substantially horizontal orientation. The arms 24, each having a top end 25, an arm length, and a free end 27, extend downward from the base bar 22, substantially in the same plane as the base bar. The top ends are attached, preferably welded, at or adjacent the top ends. The arms 24 preferably terminate at their free ends with substantially perpendicular end pieces 26, which can be positioned adjacent the free end. In one embodiment, the end pieces are substantially centered on the arms, so that they extend an equal distance on each side of the arms. The arms preferably each extend away from the base bar at an arm angle, and preferably, the arm angle is substantially ninety degrees, so that the arms are substantially perpendicular to the base bar. The end pieces are preferably substantially parallel to the base bar and thus substantially perpendicular to the arms. The arms 24 are similar in length and shape. The arms are preferably equally spaced along the base bar 22, so that the arms are positioned between form ties. The base bar 22 extends slightly beyond the position of the left-most 30 and right-most arms 28. In one embodiment, the base bar 22, arms 24, and end pieces 26 are welded together and are all made of substantially rigid wire with similar circumference. In another embodiment, the wire has surface texture.

Figure 4:
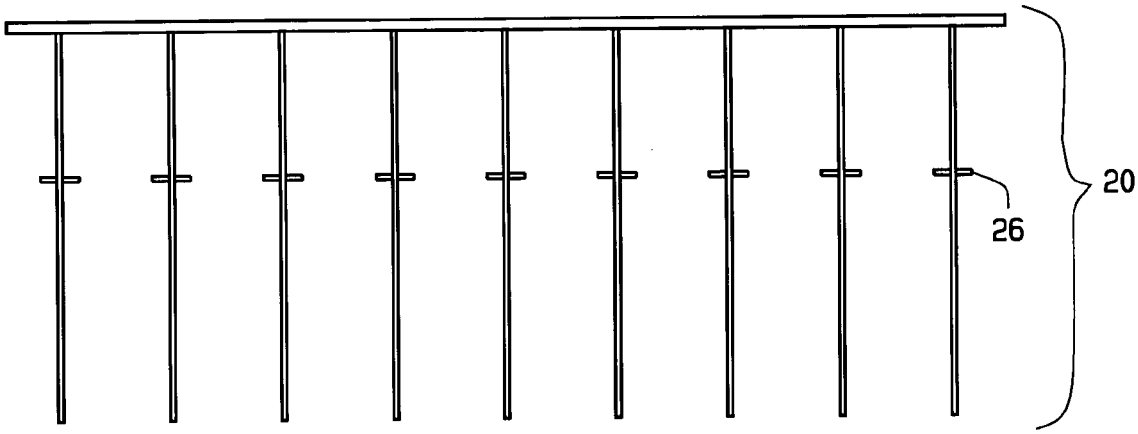
FIG. 4 is a side view of an alternative embodiment of the present invention.
Figure 5:
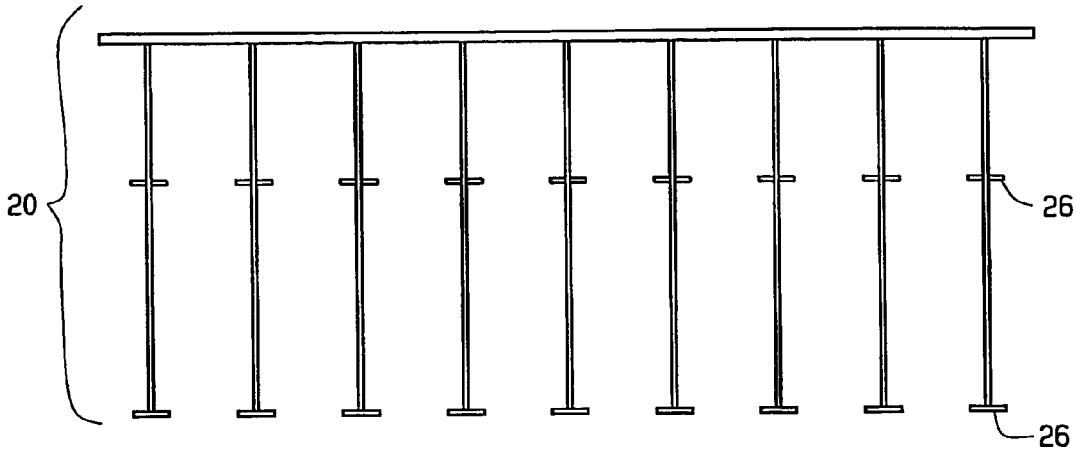
FIG. 5 is a side view of an alternative embodiment of the present invention.

The end pieces 26 are aligned in a substantially straight line to form a segmented or discontinuous bottom bar. In one embodiment, the end pieces are offset relative to the arms, so that the end pieces are longer on one side of the arms. In another embodiment, as shown in FIG. 4, the end piece is located on the arm closer to the base bar 22, with a portion of the arm extending downward from the end piece. In another embodiment, shown in FIG. 5, the arm has multiple end pieces or cross members positioned along the length of the arm. The end pieces along the arm can be evenly spaced or unevenly spaced, depending on the reinforcement needs of the arm, but the end pieces are preferably spaced to align with a set of rebar chairs defined by form ties positioned below the base bar during wall construction. Because some form ties have upper and lower sets of rebar chairs, the end pieces can be spaced for alignment with either or both the upper and lower sets of rebar chairs.

Figure 3:
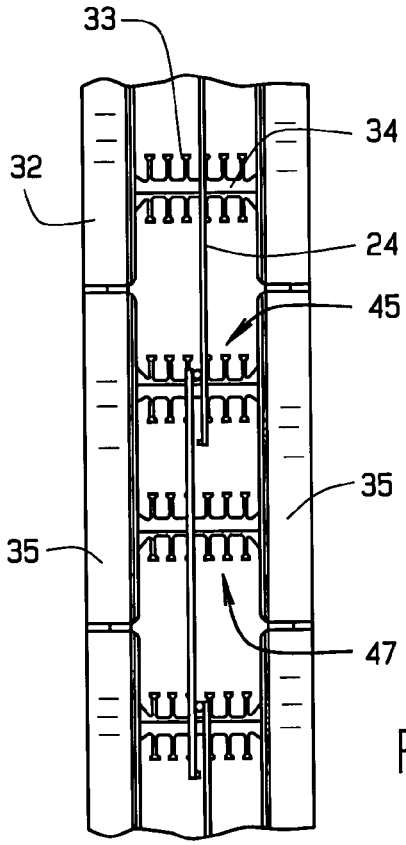
FIG. 3 is a front view of several welded wire reinforcements.

In a preferred embodiment, the welded wire reinforcement 20 is used with insulated concrete forms 32, similar to those described in U.S. application Ser. No. 09/691,934, filed on Oct. 10, 2000, which is fully incorporated herein by reference. As shown in FIGS. 2 and 3, the insulated concrete forms 32 are positioned to form concrete walls. The forms 32 include ties 34, which extend between opposed, substantially parallel, foam panels or walls 35, shown in FIG. 3. The welded wire reinforcement 20 is hung from the ties 34 between the forms 32. The base bar is held in rebar chairs 33, of the ties. In one embodiment, the arms are of a particular length so that the end pieces are aligned with rebar chairs 47 of a lower form tie. This could be the upper set 45 or lower set 47 of rebar chairs. Preferably, the arms are at least long enough so that the end pieces overlap the base bar of a lower reinforcement. In one embodiment, the end pieces would be received in the second, lower set of rebar chairs while the first, upper set of rebar chairs are supporting the base bar of the next lower reinforcement. Thus, at least the free ends of the arms and preferably the lowest discontinuous bar are positioned below the base bar of a lower reinforcement.

In a method of construction for a structure having more than one of the preferred foam block forms and more than one of the preferred reinforcements, the end pieces can be free between the walls of the form, or the reinforcement can slide left or right, so that the end pieces extend through the aligned rebar chairs of a lower tie. The end pieces have a length that is less than or equal to the approximate distance between the form ties, so that the reinforcement can be inserted from the top of a form with the end pieces and arms passing between the form ties.

In one embodiment, the welded wire reinforcement 20 is positioned to slightly overlap, in the horizontal orientation, the position of another reinforcement. As the desired number of form block levels, one or more, of the wall are stacked on each other to form layers, the reinforcements are put in place, and the next block layer, again one or more levels, is placed on top. The next reinforcement is then placed into a rebar chair that is just to one side of the previous lower and horizontally adjacent reinforcements. In this fashion, the reinforcements are hanging parallel staggered so they are added to the sequentially high form layers. Preferably the reinforcements are alternated between sets of substantially vertically aligned rebar chairs. Specifically, a first set of rebar chairs support a base bar of a reinforcement and a second set of rebar chairs, which are substantially vertically aligned with the first set, support a discontinuous bottom bar of the same reinforcement member. A next lower reinforcement is supported by substantially vertically aligned sets of rebar chairs, which are horizontally offset from the first and second sets of rebar chairs, and a horizontally adjacent reinforcement is supported by substantially vertically aligned sets of rebar chairs, which are also horizontally offset from the first and second sets of rebar chairs. When the reinforcements are placed in the desired position, concrete is poured into the space between the forms 32.

The reinforcement 20 serves to reinforce the concrete wall created using the modular concrete forms 32. The positions of the reinforcement can be varied based on level of reinforcement necessary for each wall. If more reinforcement is necessary, the reinforcements can be positioned and sized to overlap other reinforcements for greater lengths.

Figure 6:
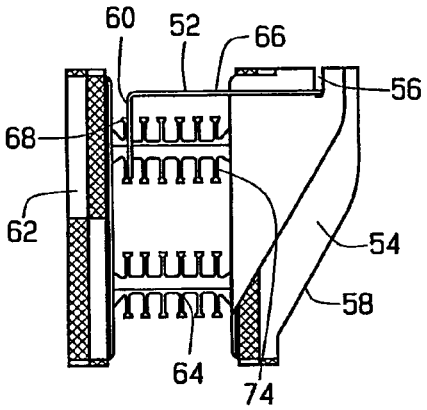
FIG. 6 is a side view of a bent wire reinforcement in a modular concrete form.
Figure 8:
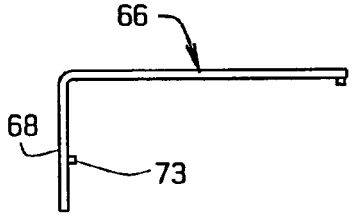
FIG. 8 is a side view of the bent wire reinforcement shown in FIG. 6.
Figure 7:
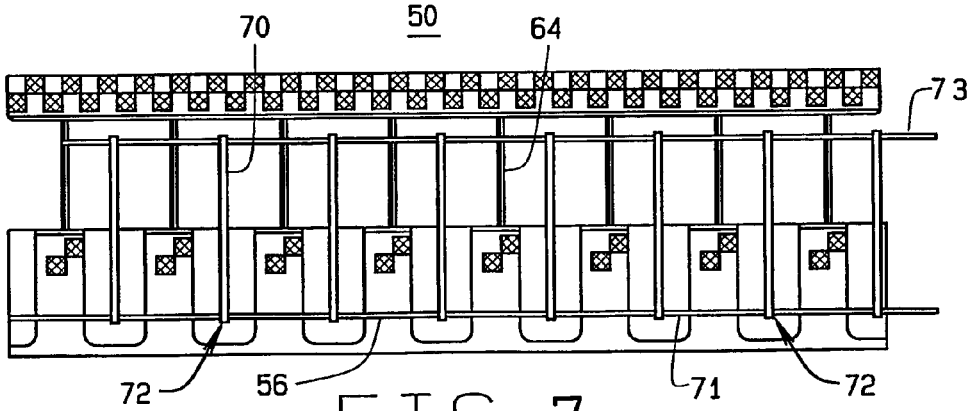
FIG. 7 is a top view the bent wire reinforcement shown in FIG. 6.

In another embodiment, referring now to FIGS. 6 and 7, a bent wire reinforcement 52 is disclosed. The bent wire reinforcement 52 is operable to reinforce a concrete wall with a perpendicular/horizontal ledge for supporting exterior finishes, such as bricks or stone, or interior flooring.

As shown in FIGS. 6 and 7, the bent reinforcement 52 includes a substantially horizontal base 66 with several arms 68. The horizontal base 66 is shaped like a ladder, with equally spaced rungs 70. The arms 68 depend at approximately a 90° angle from one edge of the base 66. The horizontal width of the bent reinforcement 52 is preferably longer than the length of the vertical arms 68. The arms are preferably continuous and equally spaced along the base and are positioned similar to the rungs 70, although in an alternate embodiment the arms are not equally spaced. An outer side rail 71 joins the outer ends of the rungs 70, and an inner side rail 73 joins the arms at 68 and rungs. The two rails 71, 73 are preferably continuous, substantially straight, parallel to each other, and perpendicular to the arms and rungs, which are preferably integral and formed by bending a straight wire to a ledge angle. In a preferred embodiment, the ledge angle is approximately ninety degrees. In an alternate embodiment, the arms are welded to the rungs. In an alternate embodiment, the bent reinforcement could be formed by welding the arms to the horizontal base. The inner rail 73 is positioned at a midpoint of the arms, so that the base stays in the desired orientation, which is preferably horizontal. The inner rail 73 is thus lower than the outer rail and is preferably held in an innermost rebar chair 74. Therefore, when positioned, the rungs are approximately horizontal in the form.

In a preferred embodiment, the reinforcement is galvanized or provided with another coating for corrosion protection. Alternatively, the reinforcement may be made of a material other than metal, including plastic.

In a preferred embodiment, the welded wire reinforcement 20 is used with insulated concrete ledge form 50, shown in FIGS. 6 and 7. The ledge form 50 is reinforced by the bent wire reinforcement 52, and includes a straight concrete form wall 62, a sloped concrete form wall 54, and a plurality of form/cross ties 64. The substantially straight concrete form wall 62 is substantially vertical. The sloped concrete form wall 54 has a slope 58 that extends upward and away from the straight form wall 62. The sloped form wall forms concrete cavities 72 at regularly spaced intervals that extend away from the plane of the sloped form wall. The cavities can be positioned between the intervals of the reinforcement rungs 70. The sloped form wall has a longitudinal slot 56 in the top of the form for receiving the outer rail 71 of the reinforcement 52, as shown in FIG. 6. The slot is discontinuous as it intersects the cavities 72. The cavities are generally triangular slots open to the gap between the form walls 62, 54, and the segments of the slot are open to the cavities.

The cross ties 64 are positioned between the two form walls 62, 54. The ties are positioned between the cavities 72, as shown in FIG. 7. The ties have rows of equally spaced and similarly positioned rebar chairs 74 along the tie extending between the two form walls 62 and 54. The straight concrete form wall 62 is positioned opposite the sloped concrete form wall 54. Several cross ties 64 are positioned between the two form walls 62 and 54. A bent reinforcement 52 is positioned above the cross ties and the slot 56 formed in the sloped form wall 54.

In the construction method, the form walls 62 and 54, cross ties 64 and bent reinforcement 52 are placed in the desired position, concrete is poured into the space between the form walls. The concrete fills around the cross ties and bent reinforcement, and also fills the slots 56, and cavities 72 formed by the sloped wall form 54. The concrete hardens around the rungs, which are in the cavities and the rail which is in the slot, to form a wall with the bent reinforcement as reinforcing rebar. Once the wall and ledge are set, the decorative brick, or other exterior feature, can be applied to the wall and ledge.

The welded wire reinforcement 20 according to the present invention provides a secure mechanism for internally increasing the strength of an insulated concrete wall created from modular concrete forms.

Thus, an improved welded wire reinforcement is disclosed which utilizes a novel configuration of arms and end pieces. This invention allows for superior reinforcement of an insulated concrete wall system. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A one-piece reinforcement for reinforcing an insulated concrete ledge form having form ties, the form ties having at least one rebar chair, the one-piece reinforcement comprising:

a substantially rigid base including a plurality of rungs for extending into a ledge of the ledge form;

a plurality of arms connected to the respective rungs, said arms extending downwardly into the ledge;

at least one inner rail extending transversely of the arms so that said at least one inner rail joins said arms; and an outer rail joining said rungs, said outer rail being positioned adjacent the terminal end of said rungs, said outer rail being at a different elevation as compared to said at least one inner rail, said at least one inner rail being positionable within the at least one rebar chair.

2. The reinforcement according to claim 1 wherein the rungs and arms are formed by continuous members bent to a ledge angle.

3. The reinforcement according to claim 2 wherein the ledge angle is approximately ninety degrees.

4. The reinforcement according to claim 1 wherein the outer rail is continuous.

5. An insulated concrete ledge form in combination with a one-piece reinforcement, the combination including:

the one-piece reinforcement comprising:

a substantially rigid base including an inner rail, an outer rail, and a plurality of rungs for extending into a ledge of the ledge form;

a plurality of arms extending downwardly into the ledge;

said outer rail being positioned adjacent the terminal end of said plurality of rungs;

said inner rail extending transversely across said plurality of arms and being positioned at an elevation which is lower than the elevation of said outer rail; and the ledge form comprising:

a substantially straight concrete form wall;

a sloped concrete form wall defining a longitudinal slot for receiving the outer rail and defining a plurality of cavities for receiving the rungs; and a plurality of cross ties joining the straight form wall and the sloped form wall, said cross ties each having at least one rebar chair, said inner rail associating with said at least one rebar chair.

6. The combination according to claim 5 wherein the cavities comprise substantially triangular slots open to a gap between the straight wall and the sloped wall.

* * * * *